US008978342B2

(12) United States Patent
Pascoe et al.

(10) Patent No.: US 8,978,342 B2
(45) Date of Patent: Mar. 17, 2015

(54) RESIDENTIAL RADIANT BARRIER ASSEMBLIES

(71) Applicant: Auburn University, Auburn, AL (US)

(72) Inventors: David Pascoe, Auburn, AL (US); David Hinson, Auburn, AL (US); Robert Sproull, Auburn, AL (US); Ryan Salvas, Windham, NH (US); John L. Locker, Florence, AL (US)

(73) Assignee: Auburn University, Auburn, AL (US)

( * ) Notice: Subject to any disclaimer, the term of this patent is extended or adjusted under 35 U.S.C. 154(b) by 0 days.

(21) Appl. No.: 13/919,159

(22) Filed: Jun. 17, 2013

(65) Prior Publication Data

US 2014/0123579 A1 May 8, 2014

Related U.S. Application Data

(60) Provisional application No. 61/660,361, filed on Jun. 15, 2012.

(51) Int. Cl.

| | |
|---|---|
| ***E04B 7/00*** | (2006.01) |
| ***E04H 12/28*** | (2006.01) |
| ***E04D 13/17*** | (2006.01) |
| ***E04D 13/16*** | (2006.01) |

(52) U.S. Cl.

CPC ..... *E04D 13/172* (2013.01); *E04B 7/00* (2013.01); *E04D 13/1606* (2013.01)

USPC ..... 52/745.05; 52/199; 52/198

(58) Field of Classification Search

CPC ..... E04C 2/00; E04C 2/02; E04C 2/26; E04C 2/28; E04C 2/284; E04C 2/292; E04C 2/296

USPC ..... 52/198, 199

See application file for complete search history.

(56) References Cited

U.S. PATENT DOCUMENTS

| | | | | |
|---|---|---|---|---|
| 4,172,915 | A | | 10/1979 | Sheptak et al. |
| 4,645,710 | A | | 2/1987 | Baitinger et al. |
| 4,778,309 | A | | 10/1988 | Bach et al. |
| 4,936,938 | A | | 6/1990 | Simpson et al. |
| 5,142,837 | A | | 9/1992 | Simpson et al. |
| 5,458,957 | A | | 10/1995 | Fryszer et al. |
| 5,466,534 | A | | 11/1995 | Newby |
| 5,561,959 | A | * | 10/1996 | Alderman et al. ..... 52/407.3 |
| 5,904,963 | A | | 5/1999 | Blatter |
| 6,037,033 | A | | 3/2000 | Hunter |
| 6,114,003 | A | | 9/2000 | Gottfried |

(Continued)

FOREIGN PATENT DOCUMENTS

| | | |
|---|---|---|
| EP | 1930363 | 6/2008 |
| EP | 1930363 | 1/2009 |

(Continued)

OTHER PUBLICATIONS

Marie O'Mahony, "Textiles for 21st-Century Living", 2006, 6 pages.

*Primary Examiner* — Mark Wendell
(74) *Attorney, Agent, or Firm* — Thomas Horstemeyer, LLP

(57) ABSTRACT

Embodiments of the present disclosure include methods of radiant heat rejection, and structures for use in same, where Aluminet® is provided in a roof or an attic of a building structure. The Aluminet® material is installed by providing a structure for the material to breathe, that is, the material is provided so that an air space surrounds it.

16 Claims, 5 Drawing Sheets

(56) References Cited

U.S. PATENT DOCUMENTS

| | | | | |
|---|---|---|---|---|
| 6,534,144 | B1 | 3/2003 | Bando et al. | |
| 6,694,693 | B2 * | 2/2004 | Alderman | 52/478 |
| 6,857,238 | B2 * | 2/2005 | Alderman | 52/407.3 |
| 7,645,003 | B2 | 1/2010 | Wenning et al. | |
| 7,805,907 | B2 | 10/2010 | Bletsos et al. | |
| 8,021,734 | B2 | 9/2011 | Lippy et al. | |
| 8,146,298 | B2 | 4/2012 | Bush et al. | |
| 2003/0124278 | A1 | 7/2003 | Clark et al. | |
| 2004/0000113 | A1 * | 1/2004 | Alderman | 52/407.5 |
| 2004/0062919 | A1 | 4/2004 | Kuchenmeister et al. | |
| 2004/0191542 | A1 | 9/2004 | McLeod et al. | |
| 2004/0202807 | A1 | 10/2004 | Earnest | |
| 2004/0202878 | A1 | 10/2004 | Vidal | |
| 2006/0014455 | A1 | 1/2006 | Sheffer | |
| 2007/0074474 | A1 | 4/2007 | Jannelle et al. | |
| 2007/0131667 | A1 | 6/2007 | Amato | |
| 2007/0166528 | A1 | 7/2007 | Barnes et al. | |
| 2009/0041936 | A1 | 2/2009 | Yializis et al. | |
| 2009/0188181 | A1 * | 7/2009 | Forbis et al. | 52/173.1 |
| 2009/0239429 | A1 | 9/2009 | Kipp et al. | |
| 2009/0269572 | A1 | 10/2009 | Orologio | |
| 2009/0272043 | A1 | 11/2009 | Zwern | |
| 2009/0308022 | A1 | 12/2009 | Kiskiras et al. | |
| 2010/0155460 | A1 | 6/2010 | Mehta | |
| 2010/0209663 | A1 | 8/2010 | Grall | |
| 2010/0229498 | A1 | 9/2010 | Pollack | |
| 2010/0236492 | A1 | 9/2010 | Calabrese | |
| 2011/0030894 | A1 | 2/2011 | Tenra et al. | |
| 2011/0033658 | A1 | 2/2011 | Boeykens et al. | |
| 2011/0165367 | A1 | 7/2011 | Kojima et al. | |
| 2011/0209426 | A1 | 9/2011 | Pollack | |
| 2011/0214372 | A1 | 9/2011 | Mullet et al. | |
| 2011/0226425 | A1 | 9/2011 | Forbis et al. | |
| 2011/0296781 | A1 * | 12/2011 | McCary | 52/309.2 |

FOREIGN PATENT DOCUMENTS

| | | |
|---|---|---|
| EP | 2119841 | 11/2009 |
| EP | 2119842 | 11/2009 |
| EP | 2119841 | 6/2010 |
| EP | 2119842 | 1/2011 |
| FR | 2905390 | 3/2008 |
| IL | 103937 | 10/1995 |
| JP | 7327518 | 12/1995 |
| JP | 11333978 | 12/1999 |
| JP | 3723543 | 12/2005 |
| WO | 9610107 | 4/1996 |
| WO | 2008044549 | 4/2008 |
| WO | 2010138993 | 12/2010 |
| WO | 2012026715 | 3/2012 |

* cited by examiner

RESIDENTIAL RADIANT BARRIER ASSEMBLIES

CROSS-REFERENCE TO RELATED APPLICATION

This application claims priority to U.S. provisional application entitled "Aluminet in Residential Radiant Barrier Assemblies," having Ser. No. 61/660,361 filed on Jun. 15, 2012, which is entirely incorporated herein by reference.

BACKGROUND

Radiant barriers are installed in homes, usually in attics, marketed primarily to reduce summer heat gain in warm climates and winter heat loss in cold climates, helping to keep energy costs low. Barriers are normally comprised of a highly reflective material, typically aluminum that reemits radiant heat from the sun back into the environment, rather than absorbing it. When the sun heats a roof, it is primarily the sun's radiant energy that makes the roof hot. A large portion of this heat travels by conduction through the roofing materials to the attic side of the roof. The hot roof material then radiates its gained heat energy onto the cooler attic surfaces, including the air ducts and the attic floor.

A radiant barrier reduces the radiant heat transfer from the underside of the roof to the other surfaces in the attic. A radiant barrier's performance is determined by three factors: emissivity, reflectivity, and the angle of radiation. Emissivity is the ratio of the radiant energy leaving a surface to that of a black body at the same temperature and with the same area. It is expressed as a number between 0 and 1, the higher the number, the greater the emitted radiation. The second factor is reflectivity, a measure of how much radiant heat is reflected by a material. It is also expressed as a number between 0 and 1, the higher the number, the greater the reflectivity. The third factor is the angle at which the incident radiation strikes the surface—a right angle (perpendicular) usually works best. All radiant barriers must have a low emissivity (0.1 or less) and high reflectivity (0.9 or more).

The current market for radiant barriers has two main functional types in the form of foil chips and foil rolls. Both types are made of the same materials, but are used in different applications within the housing industry. Studies have shown these products are successful, however, maintenance issues have proved to be an area of concern for both chips and rolls due to the accumulation of dust. Chips must be blown into attic spaces, increasing installation costs, and thus reducing their penetration into the radiant barrier market.

In recent years, the widespread use of radiant barriers has fallen out of favor in the building industry. Much of this is due to a lack of quantifiable results, and a technology that was rushed to market and not fully re-engineered or properly calibrated for building applications.

SUMMARY

Embodiments of the present disclosure, in one aspect, relate to methods and structures for radiant heat rejection.

Briefly described, embodiments of the present disclosure include a method of radiant heat rejection comprising providing a radiant barrier material (e.g., Aluminet®) in a roof of a building structure so that an air space is provided above and below the radiant barrier material, where the air space provides for convective air flow to remove heat from the radiant barrier material.

Embodiments of the present disclosure include a method of radiant heat rejection comprising providing a radiant barrier material in a roof of a building structure so that an air space is provided either above or below the radiant barrier material, where the air space provides for convective air flow to remove heat from the radiant barrier material.

Embodiments of the present disclosure further include a building structure for radiant heat rejection comprising a radiant barrier material comprising Aluminet® in a roof of the building structure, where the radiant barrier material is situated so that an air space is provided either above the radiant barrier material, below the radiant barrier material, or above and below the radiant barrier material.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
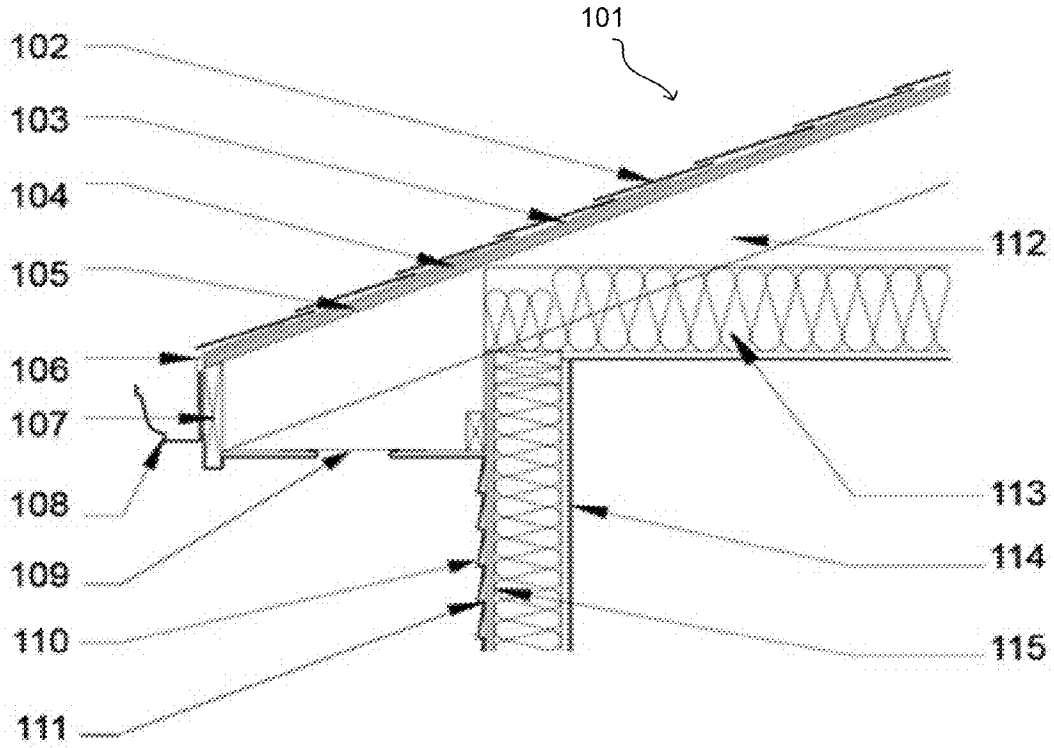
FIG. 1 illustrates traditional residential roof construction where no radiant barrier is installed.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

DEFINITIONS

Aluminet® is a mesh material made from a metalized high density polyethylene (HDPE) thermoplastic. Variations in the mesh construction are defined by the percentage of HDPE material to air gap surface area (e.g., 50% has 50 percent exposed HPDE material with 50 percent open air gaps). These mesh variations allow builders to apply and to alter the amount of radiant surface/air flow according to variations in attic construction, design, and barrier needs. The material was developed as an agriculture covering, greenhouse type applications to prevent irradiation damage to plants.

As used herein, a fascia includes the exposed vertical face of an eave.

Felt paper includes a thin, flexible sheet material made of soft fibers pressed and bonded together.

The gutter includes a channel to collect rainwater and snowmelt at the eave of a roof.

Insulation includes a material that prevents or reduces the passage, transfer, or leakage of heat through an assembly.

A joist includes one of a parallel array of light closely spaced beams used to support a low slope or level deck structure like a floor, ceiling or flat roof.

A rafter includes a framing member that runs up and down the slope of a steep roof.

A radiant barrier includes a reflective foil or metal placed adjacent to an airspace in roof or wall assemblies as a deterrent to the passage of infrared energy.

Siding includes the exterior wall finish material applied to a light frame structure.

Sheathing includes a rough covering applied to the outside of the roof, wall or floor framing of a structure.

A shingle includes a small unit of water resistant material fastened in overlapping fashion with many other units to render a wall or sloping roof, water tight.

A soffit includes the underside of a horizontal element of a building, especially the underside of a stair or roof overhang.

A soffit vent includes an opening under the eave of a roof used to allow air to flow into the attic or the space below the roof sheathing, A water membrane includes material acting as a deterent to the flow of water.

Discussion

Embodiments of the present disclosure include methods of radiant heat rejection, and structures for use in same, where Aluminet® is installed in a roof or an attic and an air space is provided around the Aluminet® material.

In general, Aluminet® is a reflective mesh fabric made from a metalized high-density polyethylene (HDPE) thermoplastic. Aluminet® was designed to be used in agriculture, specifically in/on greenhouses, to prevent irradiation damage in plants and fruits and reduce heat in greenhouses during hot days.

The present disclosure involves installation of the Aluminet® material, in one embodiment, above the roof rafters in residential building construction. In an embodiment, the Aluminet® material is installed by providing a structure for the material to breath, i.e., the material is installed so that an air space surrounds it. This air space allows for the Aluminet® to perform well as a radiant barrier in both hot and cold climates. In an embodiment, the resultant structure includes the Aluminet® material situated above the roof rafters of a residential building so that it is surrounded by an air space.

Aluminet® is a reflective mesh fabric (designed to be used on greenhouses) that is unique in that it reflects sunlight while still allowing airflow. It was originally patented in Israel and first used in the country's large expanse agricultural sites, specifically for its multifaceted benefits, simultaneously reflecting unwanted sunlight and harmful radiant heat during the summer and insulating during the winter months. Aluminet® is made from a metalized high-density polyethylene (HDPE) thermoplastic knitted into the form of a screen. It is specially treated to prevent oxidation and due to its material woven characteristics, lends itself to protecting against frost radiation damages, repelling pests, moderating day/night temperatures, and preventing condensation build-up. The use of reflective material also provides maximum radiation reflection on both sides day or night, reduces heat buildup inside the structure, provides effective heat preservation under the screen, increases light, and has uniform irradiation transfer in the range from ultra-violet to far infra-red while being highly resistant to ultra-violet radiation. As a benchmark of its performance, Aluminet has been proven in laboratory testing to reduce greenhouse temperatures 9-14%.

The knitted composition of Aluminet® also lends itself to being easily adapted as a building material. It is durable and will not unravel and can be cut and sewn at any angle with no fraying or damage to the cloth under normal use. Aluminet® is available in five varieties, categorized by the percent shade provided. They are characterized as Aluminet® R 30(%), 40(%), 50(%), 60(%), and 70(%). Standard widths range from about 6.5 to 28 feet and roll lengths are available up to about 1600 feet. It is an extremely resilient material, and maintains a five-year warranty against ultra-violet exposure in greenhouse applications.

In the present disclosure, Aluminet® is used in any roof assembly where thermal heat gain influences thermal loads on the interior of the structure, including commercial buildings, agricultural buildings, and temporary structures (e.g., shade structures, tents, inflatables, etc.).

FIG. 1 is a schematic diagram that illustrates traditional roof construction with no radiant barrier 101. The exterior surface of the roof is typically comprised of shingles 102 (e.g., fiberglass composition shingles, wood, metal, composite, stone, clay tile assemblies). Moving towards the interior, the next layers include felt paper 103, a water membrane 104, and roof sheathing 105. Laterally, the roof construction includes a drip edge 106, fascia 107, and a gutter 108. A vented soffit 109 comprises the roof structure underneath the lateral exterior. Exterior applications on the building structure include siding 110 and building paper 111. Interior structures include the roof rafters 112 (e.g., 2×8), insulation 113, interior applications 114, and wall sheathing 115.

Figure 2:
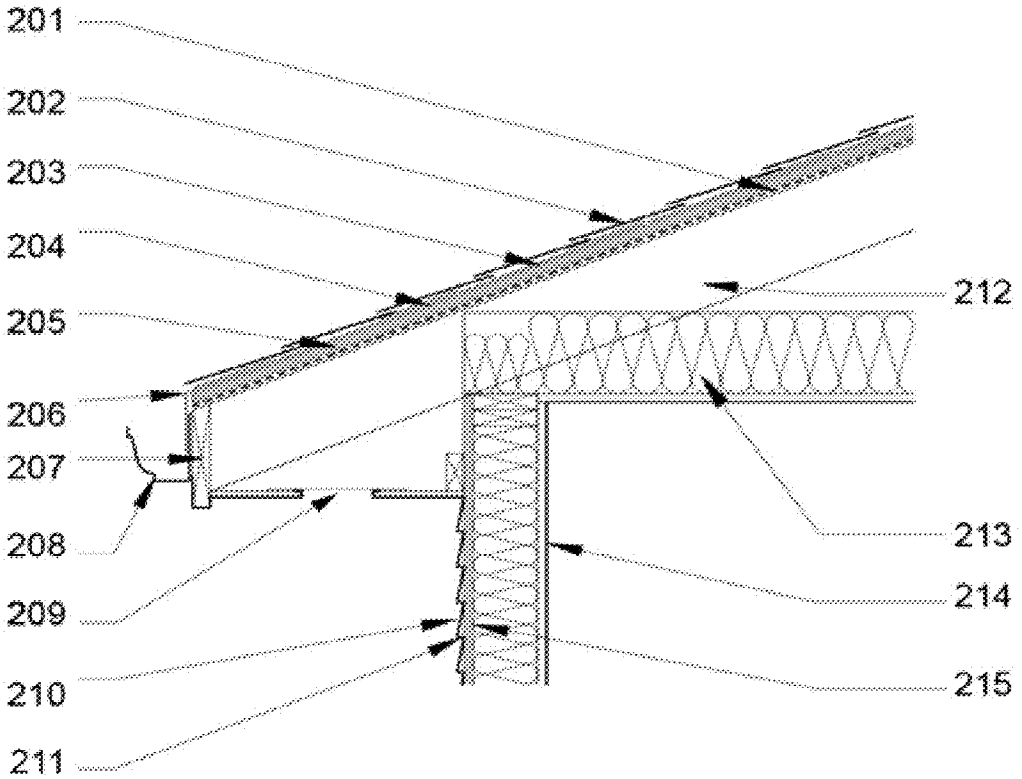
FIG. 2 illustrates an embodiment of the present disclosure where the radiant barrier is positioned between the roof rafters and the sheathing purlins of a building structure which provide an air space around the radiant barrier. It includes the addition of Aluminet® as a radiant barrier.

FIG. 2 is a schematic diagram that illustrates an embodiment of the present disclosure where Aluminet® 201 is placed between the roof rafters 212 and the roof sheathing 205 with air space only existing below the Aluminet®. The exterior surface of the roof is typically comprised of shingles 202 (e.g., fiberglass composition shingles, although alternative materials could include wood, metal, composite, stone, or clay tile assemblies). Moving towards the interior, the next layers include felt paper 203, a water membrane 204, and roof sheathing 205. Laterally, the roof construction includes a drip edge 206, fascia 207, and a gutter 208. A vented soffit 209 comprises the roof structure underneath the lateral exterior. Exterior applications on the building structure include siding 210 and building paper 211. Interior structures include the roof rafters 212 (e.g., 2×8), insulation 213, interior applications 214, and wall sheathing 215.

Figure 3:
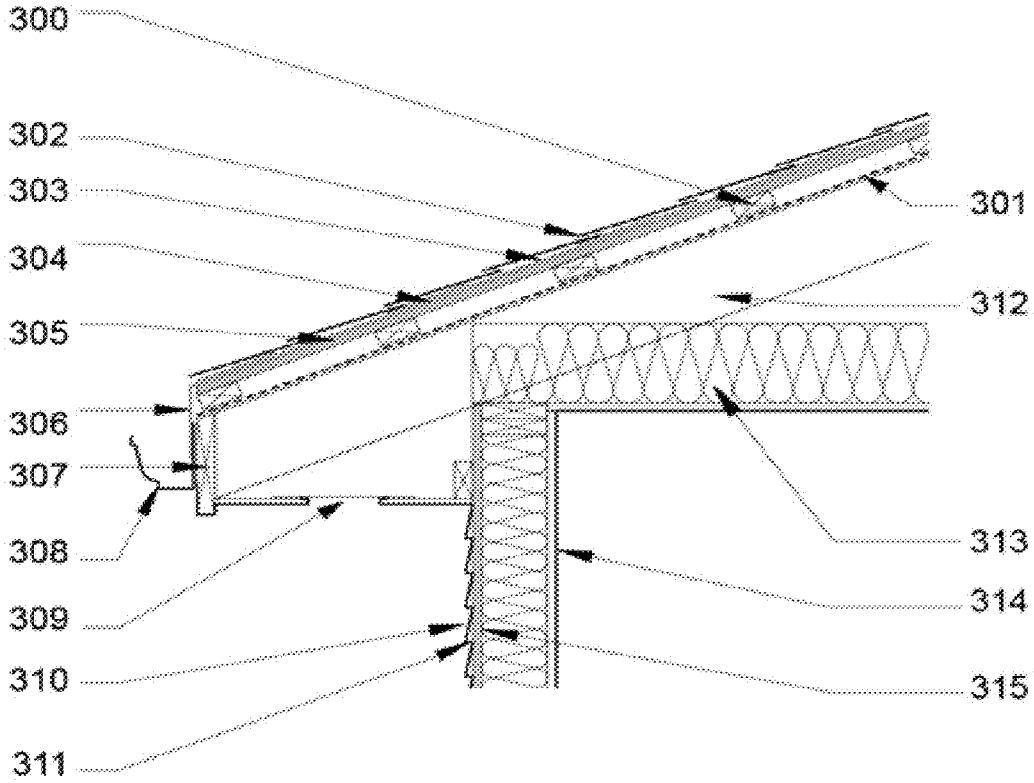
FIG. 3 illustrates an embodiment of the present disclosure where the radiant barrier is positioned above the roof rafters and below wood purlins. This assembly provides an air space both above and below the radiant barrier and includes the addition of Aluminet® as a radiant barrier.

FIG. 3 is a schematic diagram that illustrates an embodiment of the present disclosure where Aluminet® 301 is situated between roof purlins 300 and roof rafters 312, providing for an air space above and below the Aluminet®. The exterior surface of the roof is typically comprised of shingles 302 (e.g., fiberglass composition shingles, although alternative materials could include wood, metal, composite, stone, or clay tile assemblies). Moving towards the interior, the next layers include felt paper 303, a water membrane 304, and roof sheathing 305. Laterally, the roof construction includes a drip edge 306, fascia 307, and a gutter 308. A vented soffit 309 comprises the roof structure underneath the lateral exterior. Exterior applications on the building structure include siding 310 and building paper 311. Interior structures include the roof rafters 312 (e.g., 2×8), insulation 313, interior applications 314, and wall sheathing 315.

Figure 4:
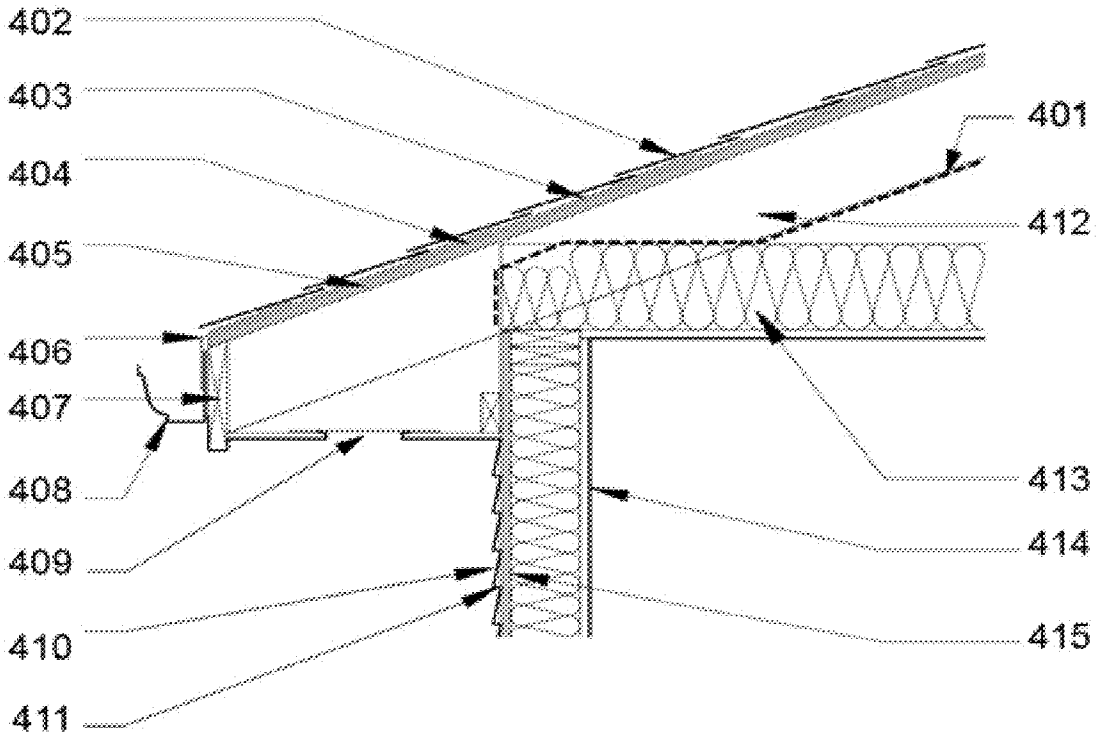
FIG. 4 illustrates an embodiment of the present disclosure where the radiant barrier is positioned at the underside of the roof rafters, and includes the addition of Aluminet® as a radiant barrier. This assembly provides an air space both above and below the radiant barrier.

FIG. 4 is a schematic diagram that illustrates an embodiment of the present disclosure where Aluminet® 401 is situated along the bottom edge of the roof rafters 412, providing for an air space above and below the Aluminet®. The exterior surface of the roof is typically comprised of shingles 402 (e.g., fiberglass composition shingles, although alternative materials could include wood, metal, composite, stone, or clay tile assemblies). Moving towards the interior, the next layers include felt paper 403, a water membrane 404, and roof sheathing 405. Laterally, the roof construction includes a drip edge 406, fascia 407, and a gutter 408. A vented soffit 409 comprises the roof structure underneath the lateral exterior. Exterior applications on the building structure include siding 410 and building paper 411. Interior structures include the roof rafters 412 (e.g., 2×8), insulation 413, interior applications 414, and wall sheathing 415.

Figure 5:
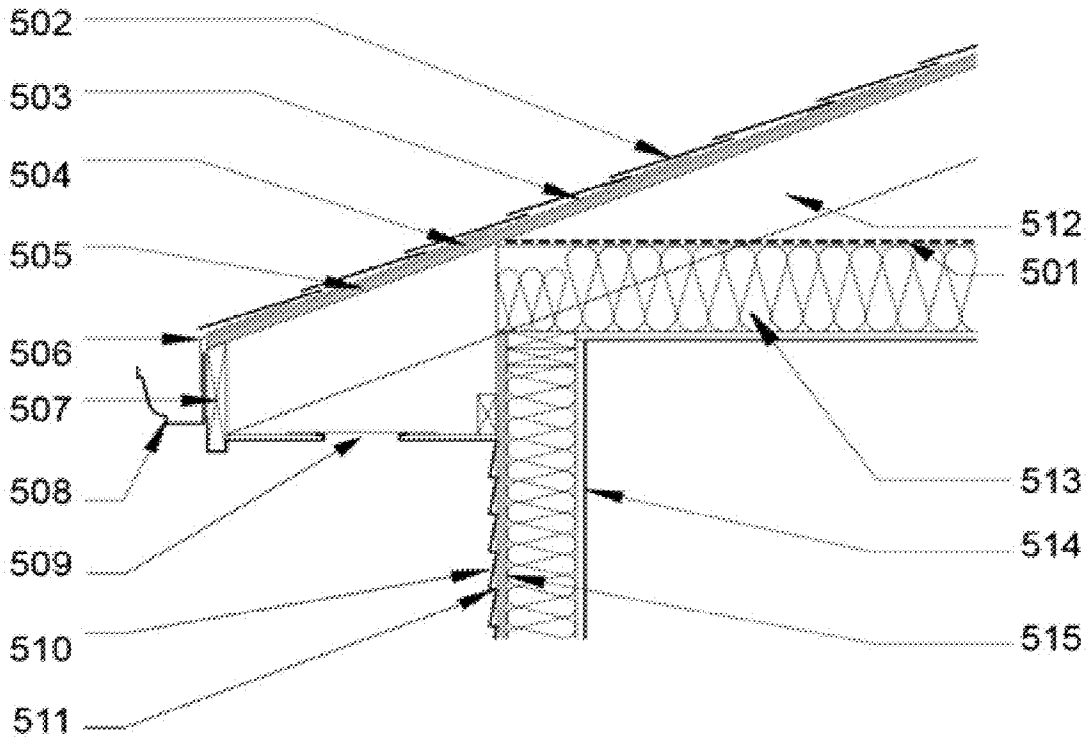
FIG. 5 illustrates an embodiment of the present disclosure where the radiant barrier is positioned on the top side of the ceiling joists. This assembly provides an air space above the radiant barrier. It includes the addition of Aluminet® as a radiant barrier.

FIG. 5 is a schematic diagram that illustrates an embodiment of the present disclosure where Aluminet® 501 is situated on top of the ceiling joists 513, providing for an air space above the Aluminet®. The exterior surface of the roof is typically comprised of shingles 502 (e.g., fiberglass composition shingles, although alternative materials could include wood, metal, composite, stone, or clay tile assemblies). Moving towards the interior, the next layers include felt paper 503, a water membrane 504, and roof sheathing 505. Laterally, the roof construction includes a drip edge 506, fascia 507, and a gutter 508. A vented soffit 509 comprises the roof structure underneath the lateral exterior. Exterior applications on the building structure include siding 510 and building paper 511. Interior structures include the roof rafters 512 (e.g., 2×8), insulation 513, interior applications 514, and wall sheathing 515.

Embodiments of the present disclosure includes a method of radiant heat rejection comprising providing a radiant barrier material (e.g., Aluminet®) in a roof of a building structure so that an air space is provided above and below the radiant barrier material. While the Aluminet® serves as a radiant reflective barrier, the air gaps/space allow for convective air flow to remove heat from the mesh material. The metallic mesh radiates heat, the heat that remains/stored on Aluminet® material acts as a heat sink, and the air gaps/convective air movement serves as a heat dissipater.

In an embodiment, the radiant barrier is provided between at least one roof purlin and at least one roof rafter. In another embodiment, the radiant barrier material comprises Aluminet®.

Embodiments of the present disclosure include a method of radiant heat rejection where the Aluminet® is provided along the bottom edge of at least one roof rafter In an embodiment, the radiant barrier comprises at least one layer. In another embodiment, the radiant barrier comprises multiple layers.

The Aluminet® material can be applied as a single layer or multiple layers. While minimal space is required for natural convection (convective heat transfer due to property of heat rising), various building designs, building materials, and applications could make use of this radiant barrier applied as a single or multiple layers with varying air spaces provided.

Embodiments of the present disclosure include Aluminet® selected from: Aluminet® 30%, Aluminet® 40%, Aluminet® 50%, Aluminet® 60%, Aluminet® 70%, Aluminet 80%, and any combination thereof.

Embodiments of the present disclosure include building structures selected from: a residential building structure, a commercial building structure, an agricultural building structure, a temporary building structure, poultry houses, zoo structures, and a combination thereof. The temporary building structure is selected from: a shade structure, a tent, an inflatable, and a combination thereof.

Embodiments of the present disclosure include a method of radiant heat rejection comprising providing a radiant barrier material in a roof of a building structure so that an air space is provided either above or below the radiant barrier material. In an embodiment, the radiant barrier material is provided between at least one roof rafter and a roof sheathing, and the air space is provided below the radiant barrier material. In another embodiment, the radiant barrier material comprises Aluminet®.

In an embodiment of the present disclosure, the Aluminet® is installed on top of at least one ceiling joist, and the air space is provided above the radiant barrier material. In another embodiment, the Aluminet® is installed in the roof structure with no air space either above or below the radiant barrier material.

Embodiments of the present disclosure include a building structure for radiant heat rejection comprising: a radiant barrier material comprising Aluminet® in a roof of the building structure, where the radiant barrier material is situated so that an air space is provided and selected from: above the radiant barrier material, below the radiant barrier material, above and below the radiant barrier material, and a combination thereof.

In an embodiment of the structure, the radiant barrier material is situated between at least one roof purlin and at least one roof rafter, and the air space is provided above and below the radiant barrier material.

In another embodiment of the structure, the radiant barrier material is situated along the bottom edge of at least one roof rafter, and the air space is provided above and below the radiant barrier material.

In another embodiment, the radiant barrier material is situated between at least one roof rafter and a roof sheathing, and the air space is provided below the radiant barrier material.

In another embodiment of the structure, the radiant barrier material is situated on top of at least one ceiling joist, and the air space is provided above the radiant barrier material.

The solar heat gain benefits of the preset disclosure apply to any climate zone where thermal heat gain (or loss) through the roof assembly is a factor in occupant comfort. These benefits apply in greater magnitude in warmer climate zones.

EXAMPLES

Example 1

Introduction

Currently, 12 states qualify as having hot-humid or hot-arid climates, and 11 states qualify as having cold climate, where the use of currently available radiant barrier technology could potentially be beneficial. This statistic accounts for approximately 33% of the total US population. The majority of the US population (67%) lives in what is defined as a temperate climate, where current radiant barrier technologies are not cost effective due to their singular performance (only work in hot climates or cold climates based on material and installation characteristics). According to conservative climate change reports, it is estimated that by 2050, roughly 55% of the projected total US population will transition to a hot-humid or hot-arid climate type. Furthermore, the amount of states in a cold climate zone drops from a 2010 count of 11 to a 2050 level of only 6, which at that moment will account for less than 2% of the projected 2050 population. Temperate climates typologies replace this decline in cold states, and at the 2050 levels comprise approximately 43% of the total projected US population. By 2050, an estimated 218,000,000 US residents would benefit from hot climate radiant barriers, 173,000,000 currently have no radiant barrier options, as the temperate climate is too dynamic for current radiant barrier technologies, and less than 7,000,000 can benefit from clod climate radiant barrier technologies. Based on these shifting numbers, the present disclosure includes the development of both better performing hot climate radiant barrier, and a multi-performance radiant barrier that can deal with the complexities of temporal shifts and dual radiant needs of a temperate climate.

The present disclosure includes the multiple performance metrics needed for a temperate climate radiant barrier, specifically a new high-performance engineered mesh. The present disclosure addresses the issues regarding material appropriateness, ease of construction, maintainability, and price points in the architectural radiant barrier industry.

Experimental Design

The performance of Aluminet® was compared to the current market radiant barriers installed using the four typical methods: above rafters, under rafters, above ceiling, and on sheathing. Thirteen model houses were used to simulate a typical house. Each house was constructed utilizing a typical bubble foil radiant barrier, a sample of Aluminet® 50% Screen, or a sample of Aluminet® 70% Screen. All tests were conducted against a control model house that contained no type of radiant barrier to ensure the most accurate end results.

In addition to the combinations of the different types of radiant barriers, two climate types were simulated to represent the areas of typical use for radiant barriers. The climate simulations were determined by laboratory constraints. The lowest achievable temperature in the testing facility was about 2° C. and was representative of an average cold temperature day in a temperate climate. The warm temperature is defined as about 38° C. to simulate a typical warm day in a hot-arid climate. A number of different testing tools were utilized to obtain results, as well as different software applications.

In order to determine how well heat reflects out of the attic space, the test room was set to about 38° C. to simulate the warm climate. Heat lamps were placed directly over the individual model houses to simulate the sun and heat radiation experienced during the day, in both the hot and cold environment testing. In order to determine how well heat enters and stays in the materials of the attic space, the test room temperature was set at about 2° C. to simulate a cold climate. The four model houses were placed in the general lab space, outside of the thermal chamber, to acclimate to room temperature at about 24° C. Once the interior temperatures reached about 24° C., the modules was moved into the thermal test chamber and observations was made to determine how long it takes the heat to dissipate through the roof.

Scale Prototypes Construction

Thirteen model houses were designed and constructed. The effectiveness of a radiant barrier on a house was shown by testing multiple radiant barrier types in different installation locations on model houses. By simulating an actual house, the design augmented a standard model house to include some typical features found in residential construction. A ceiling was installed to simulate the difference in attic space and living space. The elevated floor in the model house encloses the building envelope and decreases air leakage. R-13 batt insulation lined the interior walls and atop the ceiling in the attic space. The front panel of the model house was removable to allow ease of access for the probes and to decrease acclimation time.

Testing Procedures

To maintain a controlled environment and ensure equal testing conditions, the four model houses exhibiting the four modes of radiant barrier installations were examined simultaneously. The houses were placed in the testing facility early to acclimate to temperature equilibrium. The measurement of the initial temperature and humidity level was taken for consistency between the different sets of houses. Throughout the experiment, the operator monitored the setup and recorded temperature readings on about 15-minute intervals for about 90 minutes upon exposure to the imposed hot or cold climate.

To determine how well heat either enters and stays in the materials or reflects out of the attic space, test results were based on Infrared Technology. Computerized Thermal Imaging, Inc. (CTI) software and a CTI Processor Camera were used to provide a real-time computer image of the model house surfaces color-coded by temperature.

The computer software offers an exact surface temperature reading for each pixel in the image. Since only surface temperature readings are available from the CTI camera, probes were inserted into each model house, one in the attic and one in the living space, for interior temperature readings using an YSI Precision 4000 Thermometer. The interior temperature readings were also determined using the WIBGET Camera on a tripod equipped with a heat stress monitor.

The test documented the temperature readings in four locations: the environment outside the structure, the roof surface, the attic space, and the living space of the house. To achieve an accurate reading, the individual probes must be dropped into the spaces of each house avoiding surface contact due to heat conduction. The temperatures were recorded manually and then exported into Microsoft Excel, producing a dataset of results in spreadsheet format. Camera images were also exported for further visual documentation. The temperature range and pixel increments are set the same within each test. They are not the same from test to test. The center shingle is selected for the image to analyze temperature distribution. The selected area analysis includes: high temperature, low temperature, average temperature, and standard deviation.

Experimental Results

The results were broken down into charts based on the locations of the probes and climate type. The data in the charts is organized by installation methods and the material applied.

Cold Environment Chamber Data
Cold Temperature Change in Attic (° C./min.)

| Test | Alum 50 | Alum 70 | Bubble | Control |
|---|---|---|---|---|
| Below Rafters | (0.23) | (0.25) | (0.29) | (0.21) |
| Above Rafters | (0.21) | (0.14) | (0.25) | (0.22) |
| Above Ceiling | (0.27) | (0.27) | (0.31) | (0.24) |
| On Sheathing | (0.22) | (0.23) | (0.22) | (0.23) |

The most significant piece of data in the above table is the performance of the Aluminet® 70 when installed above the rafters. This test performed far better than the control house with an (about 0.14° C./min.) change in temperature. The next trend noticed is the poor performance of the bubble radiant barrier throughout all application methods.

Cold Temperature Change in Living (° C./min.)

| Test | Alum 50 | Alum 70 | Bubble | Control |
|---|---|---|---|---|
| Below Rafters | (0.18) | (0.13) | (0.13) | (0.10) |
| Above Rafters | (0.14) | (0.14) | (0.16) | (0.11) |
| Above Ceiling | (0.16) | (0.19) | (0.17) | (0.12) |
| On Sheathing | (0.13) | (0.17) | (0.16) | (0.12) |

All radiant barrier types tested in the living space performed to some degree worse than the control house. The closest to the control house's performance numbers were the Aluminet® 70 in both rafter installations, with only an about 0.3 deviation from the control house benchmarks. Although none performed as good as the control house, it is notable with regard to the combined temperate performance to note that the differences are not significant between the 70 and the control. Based on both cold sets of data, neither of the Aluminet® test materials would be suggested for use in a strictly cold climate.

Hot Environment Chamber Data
Hot Temperature Change in Attic (° C./min.)

| Test | Alum 50 | Alum 70 | Bubble | Control |
|---|---|---|---|---|
| Below Rafters | 0.24 | 0.24 | 0.21 | 0.25 |
| Above Rafters | 0.26 | 0.23 | 0.20 | 0.26 |
| Above Ceiling | 0.28 | 0.27 | 0.27 | 0.29 |
| On Sheathing | 0.20 | 0.20 | 0.16 | 0.21 |

The bubble radiant barrier performed the best amongst these tests, with the results being significantly lower than the control house. Both Aluminet® products produced temperature changes lower than that of the control house, and in some instances, matched the performance of the highly insulated bubble foil. The trend throughout this data is that any type of installed radiant barrier is better than the control.

Hot Temperature Change in Living (° C./min.)

| Test | Alum 50 | Alum 70 | Bubble | Control |
|---|---|---|---|---|
| Below Rafters | 0.09 | 0.08 | 0.08 | 0.09 |
| Above Rafters | 0.10 | 0.08 | 0.10 | 0.13 |
| Above Ceiling | 0.09 | 0.09 | 0.07 | 0.10 |
| On Sheathing | 0.08 | 0.08 | 0.07 | 0.08 |

This data is very similar to the data presented in the attic tests, but the temperature changes are not as significant. The most noteworthy piece of data is the temperature change of the Aluminet® 70 radiant barrier installed above the rafters. This change was about (0.08), which was much lower than the control house temperature change of about (0.13). Throughout the tests the Aluminet® products performed the same if not better than the control house.

Synthesized Temperate Environment Data

Based on the two-tiered nature of the problem scope, the analysis of performance of radiant barriers in a temperate climate with consistent temporal swings was more complicated than the thermal chamber was capable of accurately representing. Therefore, the applicability of temporal climate performance came in the form of synthesizing the results from all tests, and through synthetic diagramming, arriving at which, if any, radiant barriers had a satisfactory blended average between hot and cold weather temperature performance.

All of the above data was plotted on a four-quadrant rose matrix in regard to material, installation location, and temperature change (° C./min.) and connected the plotted coordinates. By calculating the area of the inscribed quadrilateral, a way of quantitatively comparing the blended climate performance of each material in each location through the course of all the tests was achieved. The smaller the measures area of the quadrilateral, the better the material in the installed position performed all around.

According to this metric, the Aluminet® 70 installed above the roof rafters performed significantly better than any other material/installation cocktail. This sequence also had the lowest combined change in temperature for both combined cold climate profiles (living and attic space), and had excellent heat temperature change characteristics. The positive performance of the radiant barrier in the large spectrum of temperatures was a testament to the density of the mesh and its installation above the roof rafters.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In an embodiment, the term "about" can include traditional rounding according to the numerical value. In addition, the phrase "about 'x' to 'y'" includes "about 'x' to about 'y'".

It should be emphasized that the above-described embodiments of the present disclosure are merely possible examples of implementations, and are merely set forth for a clear understanding of the principles of the disclosure. Many variations and modifications may be made to the above-described embodiments. All such modifications and variations are intended to be included herein within the scope of this disclosure and protected by the following claims.

Therefore, at least the following is claimed:

1. A method of radiant heat rejection comprising:

providing a radiant barrier material in a roof of a building structure along a bottom edge of at least one roof rafter so that a first air space is provided above the radiant barrier material and a second air space is provided below the radiant barrier material, wherein the first air space is positioned between the radiant barrier material and a surface of the roof and the second air space is positioned between the radiant barrier material and the at least one roof rafter; and wherein the first air space and the second air space provide for convective air flow that removes heat from the radiant barrier material.

2. The method of claim 1, wherein the radiant barrier material is provided between at least one roof purlin and the at least one roof rafter.

3. The method of claim 2, wherein the radiant barrier material comprises Aluminet®.

4. The method of claim 1, wherein the radiant barrier material comprises Aluminet®.

5. The method of claim 1, wherein the radiant barrier material further comprises a plurality of layers of the radiant barrier material.

6. The method of claim 1, wherein the building structure is selected from a group consisting of: a residential building structure, a commercial building structure, an agricultural building structure, a temporary building structure, and a combination thereof.

7. A building structure for radiant heat rejection comprising:

a radiant barrier material comprising Aluminet® in a roof of the building structure, wherein the radiant barrier material is situated so that a first air space is provided above the radiant barrier material and a second air space is provided below the radiant barrier material, wherein the first air space is positioned between the radiant barrier material and a surface of the roof and the second air space is positioned between the radiant barrier material and a support component;

wherein the radiant barrier material is situated along a bottom edge of at least one roof rafter, and the air space is provided above and below the radiant barrier material; and wherein the first air space and the second air space provide for convective air flow that removes heat from the radiant barrier material.

8. The building structure of claim 7, wherein the radiant barrier material is situated between at least one roof rafter and a roof sheathing, and the air space is provided below the radiant barrier material.

9. The building structure of claim 7, wherein the radiant barrier material is situated on top of at least one ceiling joist, and the air space is provided above the radiant barrier material.

10. The building structure of claim 7, wherein the building structure is selected from a group consisting of: a residential building structure, a commercial building structure, an agricultural building structure, a temporary building structure, and a combination thereof.

11. The building structure of claim 7, wherein the Aluminet® comprises at least one layer selected from a group consisting of Aluminet® 30%, Aluminet® 40%, Aluminet® 50%, Aluminet® 60%, Aluminet® 70%, Aluminet®80%, and a combination thereof.

12. A method of radiant heat rejection comprising:

providing a radiant barrier material comprising Aluminet® in a roof of a building structure so that a first air space is provided above the radiant barrier material and a second air space is provided below the radiant barrier material, wherein the first air space is positioned between the radiant barrier material and a surface of the roof and the second air space is positioned between the radiant barrier material and at least one roof rafter; and wherein the first air space and the second air space provide for convective air flow that removes heat from the radiant barrier material.

13. The method of claim 12, wherein the radiant barrier material is provided between at least one roof purlin and the at least one roof rafter.

14. The method of claim 12, wherein the radiant barrier material further comprises a plurality of layers of the radiant barrier material.

15. The method of claim 12, wherein the building structure is selected from a group consisting of: a residential building structure, a commercial building structure, an agricultural building structure, a temporary building structure, and a combination thereof.

16. The method of claim 12, wherein the Aluminet® comprises at least one layer selected from a group consisting of Aluminet®30%, Aluminet® 40%, Aluminet® 50%, Aluminet® 60%, Aluminet® 70%, Aluminet® 80%, and a combination thereof.

* * * * *